US006547367B1

(12) United States Patent
Hamada

(10) Patent No.: US 6,547,367 B1
(45) Date of Patent: Apr. 15, 2003

(54) INK JET PRINTING APPARATUS AND A JUDGEMENT METHOD OF AN INK EJECTION STATE OF AN INK JET HEAD

(75) Inventor: Yasuhiro Hamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/584,731

(22) Filed: Jun. 1, 2000

(30) Foreign Application Priority Data

Jun. 7, 1999 (JP) ..... 11-160154
May 30, 2000 (JP) ..... 2000-159934

(51) Int. Cl.[7] ..... B41J 2/165
(52) U.S. Cl. ..... 347/23; 347/19; 347/33
(58) Field of Search ..... 347/19, 23, 33, 347/29

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 6,076,910 A | * | 6/2000 | Anderson | 347/19 |

FOREIGN PATENT DOCUMENTS

| | | | |
|---|---|---|---|
| EP | 0380056 | * | 8/1990 |
| EP | 0 622 202 | | 11/1994 |
| EP | 0794060 | * | 3/1996 |
| EP | 0744295 | * | 11/1996 |
| EP | 0 925 929 | | 6/1999 |
| EP | 1 059 170 | | 12/2000 |
| JP | 54-56847 | | 5/1979 |
| JP | 59-123670 | | 7/1984 |
| JP | 59-138461 | | 8/1984 |
| JP | 60-71260 | | 4/1985 |
| JP | 63-260449 | * | 10/1988 |
| JP | 9-94948 | | 4/1997 |
| JP | 10-193643 | * | 7/1998 |

* cited by examiner

*Primary Examiner*—Huan Tran
(74) *Attorney, Agent, or Firm*—Fitzpatrick, Cella, Harper & Scinto

(57) ABSTRACT

In an ink jet print head including a plurality of ejection openings arranged therein for ejecting an ink, with the head carrying out printing by moving in a scanning direction relative to a printing medium, an ejection failure is detected promptly and accurately and adhesion of the ink to an ejection face on which the ejection openings are formed is also detected, without affecting print operation sequences. To achieve this, the following operations are performed: While an ink jet print head is being relatively moved in the scanning direction, a light beam is supplied diagonally of an arrangement direction of the plurality of ejection openings and in a direction traversing a trace of the ejected ink. The ink is ejected through the plurality of ejection openings in accordance with predetermined data, and a manner of ink ejection from each of the plurality of ejection openings is detected based on how the ejected ink is blocking the light beam. Based on the detection contents, it is also determined whether or not the ink adheres to the ejection face.

15 Claims, 12 Drawing Sheets

INK JET PRINTING APPARATUS AND A JUDGEMENT METHOD OF AN INK EJECTION STATE OF AN INK JET HEAD

This application is based on Japanese Patent Application Nos. 11-160154 (1999) filed Jun. 7, 1999 and 2000-159934 (2000) filed May 30, 2000, the contents of which are incorporated hereinto by reference.

BACKGROUND OF THE INVENTION

Field of the Invention

The present invention relates to an ink jet printing apparatus, and in particular, to a technique for detecting a failure in ejection from an ink jet print head and detecting adhesion of an ink to a face of the ink jet print head on which ejection openings are formed.

Ink jet printing apparatuses based on the ink jet printing method, one of non-impact printing methods, can perform high-density and high-speed printing with low noise, by ejecting inks from ejection openings to print images on printing media such as paper, cloths, plastic sheets, or OHP sheets (hereafter also simply referred to as "recording paper"). The ink jet printing method is very excellent and has a simple configuration, but has problems.

That is, since ink jet printing apparatuses directly eject inks onto the printing medium through the fine ejection openings to form images, ejection may fail when a print head face with the ejection openings formed therein (hereafter referred to as an "ejection face") is wet with the inks. There are two main causes of the wetting. First, the inks ejected for printing may strike on the printing medium and partly bounce off without adhering thereto, or upon ink ejection, in addition to the inks principally involved in printing, fine ink droplets may be ejected and float in the atmosphere. These inks or fine ink droplets may adhere to the ejection face.

An ejection failure may also occur during a recovery operation for preventing the ejection openings from being clogged or for removing the clog, that is, when a cap is placed on the ejection face and removed therefrom after sucking the ink from nozzles. In this case, ink resulting from this processing may remain on the ejection face. This is because the sucking operation causes the cap to be filled with the ink, so that when the cap has been removed from the ejection face, the ink in contact with the ejection face remains there. To prevent this, the ejection face may be subjected to liquid repulsion treatment, but this method still has difficulties in completely eliminating the remaining ink.

In addition, in order to remove the ink remaining in the cap when the cap is removed from the ejection face after the sucking through the ejection openings, a thin-plate-shaped absorbent made of a porous resin or a nonwoven cloth is installed in the cap. Without the absorbent, if the sucking operation is performed while the cap is open in order to eliminate the ink therefrom, only the ink immediately close to a drain opening in the cap is sucked, while the ink surrounding the opening remains. That is, the absorbent allows a negative pressure or sucking pressure to act gently, thereby causing the ink to be uniformly sucked from the cap.

If such the undesired inks adhere to neighborhoods of the ejection openings, an inappropriate ejection may occur, including a "bias" wherein the ink ejection direction deviates from a normal one or an "ejection failure" wherein the ink cannot be ejected, the print quality lowers in result. Since particularly strict quality control is required in using the ink jet printing apparatus for industrial purposes as a textile printing or a printing machine, such degradation is a critical problem associated with the reliability of the apparatus.

To solve this problem, a method is often employed which wipes the ejection face using a blade (which may also be referred to as a "wipers") composed of an elastic member such as rubber (this method is hereafter referred to as "wiping"). To achieve the wiping, the print head is scanned by the stationary blade to wipe the ejection face, or while the print head is stationary, the blade is translated or rotated to come in contact with the ejection face.

In the above described conventional examples, however, if the wiping is insufficient for any reason (this is hereafter referred to as "inappropriate wiping), part of the ink fails to be wiped, resulting in an inappropriate ejection.

SUMMARY OF THE INVENTION

It is an object of the present invention to promptly and reliably detect an ejection state of an ink jet print head without affecting actual print operation sequences.

It is another object of the present invention to detect adhesion of an ink to an ejection face during an inappropriate ejection detecting operation, thereby effectively preventing inappropriate ejection arising from inappropriate wiping.

Generally, the present invention comprises a light emitting section for emitting a light beam in a direction diagonally traversing an arrangement direction of nozzles and a light receiving section used for detecting whether an ink droplet or an ink adhered on an ejection face is passed in the light beam.

In a first aspect of the present invention, there is provided an ink jet printing apparatus for carrying out printing by moving an ink jet head in a scanning direction relatively to a printing medium, the ink jet head having a plurality of ejection openings arranged therein for ejecting an ink, the apparatus comprising:

means for emitting a light beam in a direction which is different from the arrangement direction of the plurality of the ejection openings and which traverses a trace of the ink ejected through the ejection openings;

means for receiving the emitted light beam;

means for controlling the light emitting means to emit the light beam and for controlling the ink jet head to eject ink through the plurality of the ejection openings in accordance with predetermined data, while the ink jet head is being relatively moved in the scanning direction between the light emitting means and the light receiving means; and means for detecting ink ejection states from the plurality of the ejection openings based on light beam receiving states at the light receiving means.

Here, the light emitting means and the light receiving means may be provided along the scanning direction of the ink jet head and outside a print area.

In a second aspect of the present invention, there is provided a judgement method of an ink ejection state of an ink jet head for carrying out printing by moving in a scanning direction relatively to a printing medium, the ink jet head having a plurality of ejection openings arranged therein for ejecting an ink, the method comprising the steps of:

controlling light emitting means to emit a light beam in a direction which is different from the arrangement direction of the plurality of the ejection openings and which traverses a trace of the ink ejected through the ejection openings and controlling the ink jet head to eject ink through the plurality of the ejection openings in accordance with predetermined data, while the ink jet head is being relatively moved in the scanning direction; and detecting ink ejection states from the plurality of the ejection openings based on blocking states of the light beam.

The first or second aspect of the present invention may comprise means for, or a step of judging adhesion of the ink to a face of the ink jet head on which the plurality of the ejection openings are formed, based on the detection by the detecting means or step.

When the judgement means judges that the ink adheres to the face, the face may be wiped after the detection means or step has completed a series of detection sequences for the plurality of the ejection openings.

Moreover, the judgement means or step may determine whether that ejection opening for which a normal ejection has not been detected during the detection sequences carried out by the detection means or step for the plurality of the ejection openings is identical and/or close to that for which the normal ejection was not detected during the previous detection sequence, and wherein if the result of the determination is affirmative, the judgement means or step may judge that the ink adheres to the face.

Here, means for or step of storing information of the ejection opening for which the normal ejection has not been detected during each of the detection sequences carried out by the detection means or step for the plurality of the ejection openings may be comprised, and wherein the judgement means or step makes the determination based on the stored information.

On judging that the ink adheres to the face, the judgement means or step may allow to store this judgement.

In the above, the ink jet head may have heating elements for generating thermal energy to make the ink to film-boil, as an energy used for ejecting the ink.

Incidentally, hereafter, the term "print" (hereinafter, referred to as "record" also) represents not only forming of significant information, such as characters, graphic image or the like but also represents to form image, patterns and the like on the printing medium irrespective of whether it is significant or not and whether the formed image elicited to be visually perceptible or not, in broad sense, and further includes the case where the medium is processed.

In addition, the term "printing medium" refers to paper for use in general printing apparatuses as well as a medium such as a cloth, a plastic film, and a metallic plate and the like and any substance which can receive inks ejected by the heads in a broad sense.

Further, the term "ink" has to be understood in a broad sense similarly to the definition of "print" and should include any liquid to be used for formation of image patterns and the like or for processing of the printing medium.

Additionally, the term "nozzle", as used hereafter, collectively refers to an ejection opening, a liquid passages in communication therewith, and an element for generating energy for use in ink ejection, unless otherwise specified.

In addition, the term "ejection failure" refers to an actual failure to eject the ink from the nozzle and a failure to appropriately eject a predetermined amount of ink in a predetermined direction, that is, an inappropriate ejection.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention will be described below in detail with reference to the drawings.

(General Configuration)

Figure 1:
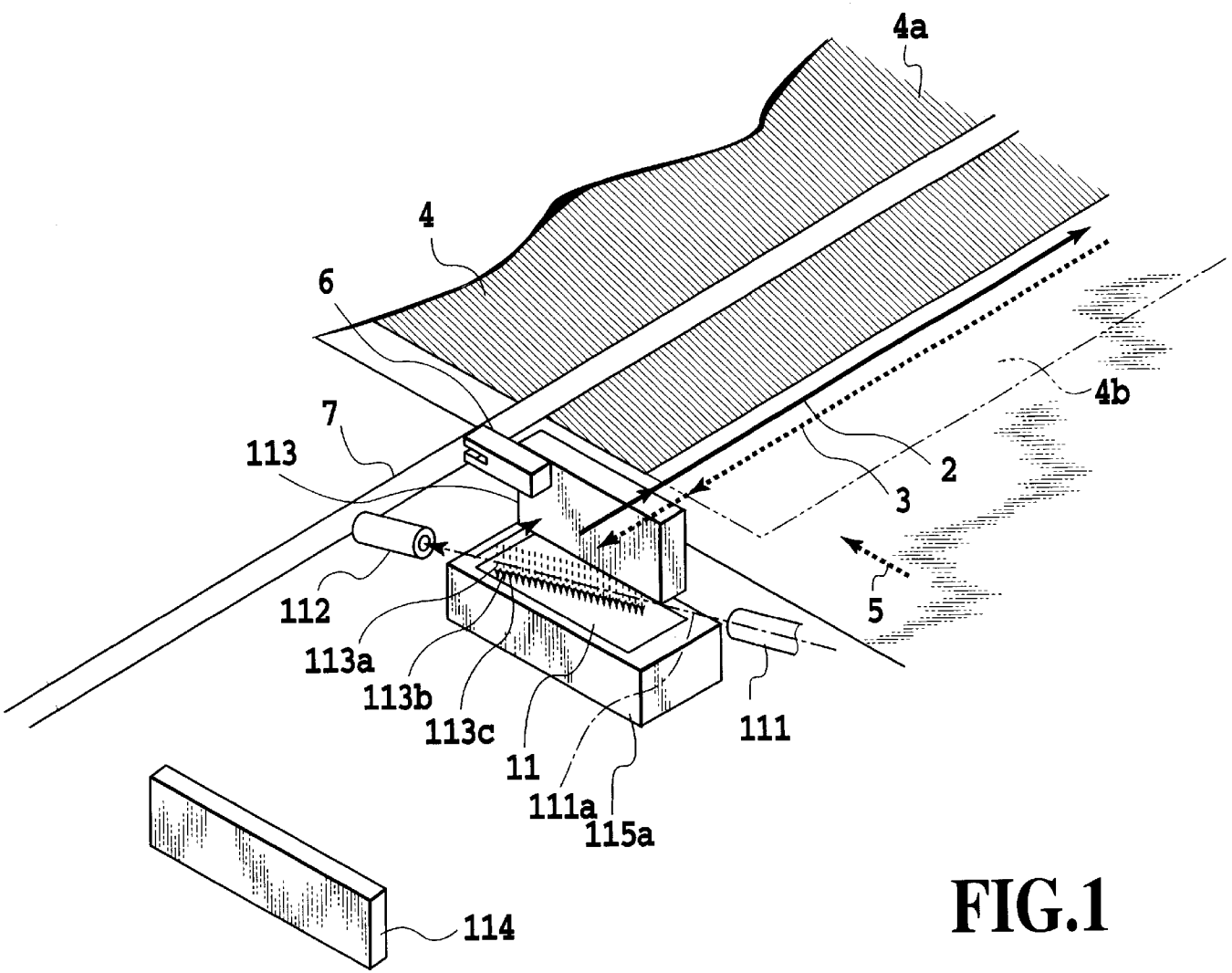
FIG. 1 is a schematic perspective view showing an example of a configuration of a principal part of an ink jet printing apparatus including a mechanism for detecting an ejection failure or adhesion of an ink to an ejection face according to an embodiment of the present invention.

FIG. 1 shows an example of a configuration of a principal part of an ink jet printing apparatus (an ink jet printer) including a mechanism for detecting an ejection failure and/or adhesion of an ink to an ejection face.

An ink jet head or print head 113 performs an ink ejecting operation after having its face wiped by a wiping unit 114, and performs a printing operation both in moving (main scanning) in the direction of an arrow 2 (forward), shown by a solid line and in moving in the direction of an arrow 3 (backward), shown by a broken line.

Reference numeral 4 designates a printing medium such as paper or a cloth which is intermittently sub-scanned (fed) in the direction of an arrow 5. A hatched portion 4*a* denotes an already printed portion of the printing medium, while a non-hatched portion 4*b* denotes a portion to be printed. For main scanning, the position of the head can be detected by reading a scale of a linear encoder 7 fixed to the apparatus main body using a position reading section or pickup section 6 mounted on a carriage (shown at reference numeral 205 in FIG. 6, which will be described later) with the head placed thereon. The encoder 7 is disposed as a reference for image printing operations to enable ideal landings of inks on the printing medium 4 to improve the image printing quality.

A dot and dash line shown at reference numeral 111*a* denotes a light beam (e.g. a laser beam) output from a light emitting section 111 after thinning. During main scanning movement of the head 113, ink droplets 113*a*, 113*b*, 113*c*, . . . are ejected from ejection openings. The light beam 111*a* is received by a light receiving section 112, which then detects its light intensity. Reference numeral 115 designates a member for receiving an ejected ink for the ink droplet detecting processing and which is mounted on a support base 115*a*. A small amount of wash water is intermittently injected into this member and discharged by a suction pump (not shown).

Although in the figure, only one print head for ejecting an ink for one color (for example, black (Bk)) is shown, a plurality of print heads may be provided so as to correspond to colors such as cyan (C), magenta (M), and yellow (Y). Instead of such separate heads for different colors, a single print head may include a group of nozzles for ejecting the Bk ink and a group of nozzles for ejecting the Y, M, and C inks, wherein the groups are arranged in juxtaposition. Alternatively, a print head with a group of nozzles for ejecting the Bk ink and a print head with a group of nozzles for ejecting the Y, M, and C inks may be independently arranged in juxtaposition.

Furthermore, the print head may be integrated with an ink tank constituting an ink supply source or may be supplied with the ink via a tube or the like from an ink tank provided at a different site of the apparatus. In addition, if the print head is integrated with the ink tank, the print head and the ink tank may be formed into a cartridge that can be removably installed in the apparatus main body (the carriage), or the print head and the ink tank may be separable so that, for example, the ink tank alone can be replaced with a new one.

(Configuration of a Control System for the Apparatus)

Figure 2:
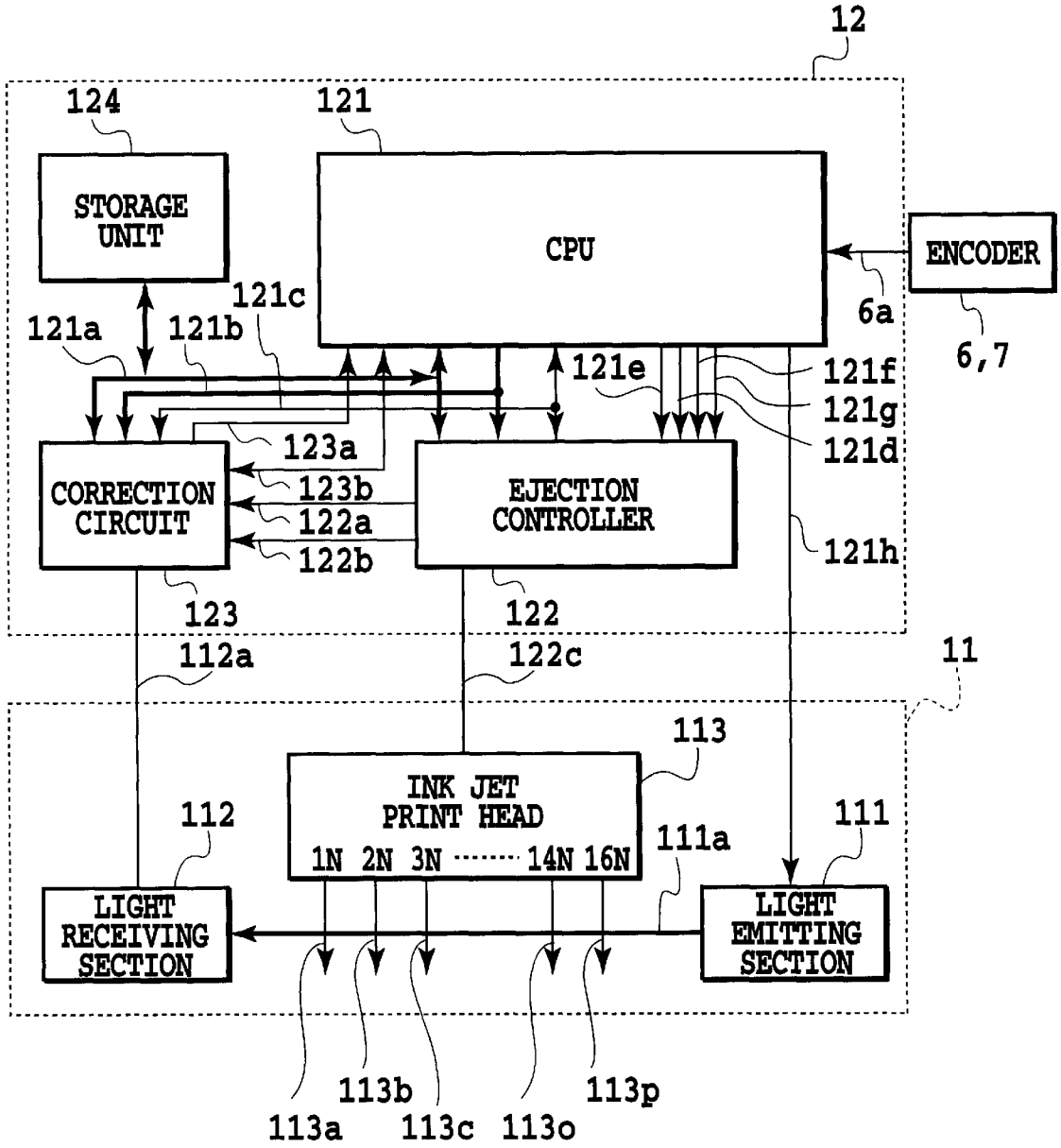
FIG. 2 is a block diagram showing an example of a configuration of a control system for the ink jet printing apparatus shown in FIG. 1.

FIG. 2 shows an example of a configuration of a control system for an ink jet printing apparatus including a block for detecting an ejection failure or adhesion of the ink to the ejection face.

In the figure, reference numeral 11 designates a unit associated with functions of detecting an ejection state and adhesion of the ink to the ejection face. This unit includes the ink jet print head 113, the light emitting section 111, and the light receiving section 112. Reference numeral 12 designates a unit associated with head control functions and other functions of judging an ejection state and adhesion of the ink to the ejection face. This unit includes a CPU 121 for electrically controlling the entire ink jet printer, and ejection controller 122, a correction circuit 123, and a storage unit 124 that stores the previous ejection state data.

The CPU 121 temporarily stores previously prepared print images or images transmitted from an external host device (which is a source for supplying image data and which may be in the form of a computer acting as an information processing device, an image reading device, or another device) and sequentially transfers desired print images to the ejection controller 122 in accordance with print operation control for the inkjet printer. In this example, the CPU 121 transfers a BVE* signal 121*d* indicative of an effective image area in a main scanning direction of the ink jet print head 113 that carries out printing based on the serial scanning method as described in FIG. 1, a VE* signal 121*e* indicative of an effective image area in an ejection opening-arranging direction of the ink jet print head 113, an image signal 121*f* for printing, and a transfer synchronization clock 121*g* for the image signal. These four signals are generated based on a reference signal 6*a* from the encoder 6, 7 that monitors the position of the ink jet print head 113, to specify which data to print and where to print this data.

In addition, the ejection controller 122, the correction circuit 123, and the storage unit 124 are connected together via a CPU data bus 121*a*, a CPU address bus 121*b*, and a control bus 121*c*. A device chip select signal, a bus read/write signal, a bus direction signal, and the like are transmitted on the control bus 121.

Further, the CPU 121 outputs a light emitting control signal 121*h* for turning on and off a light source in the light emitting section 111 of the unit 11 for detecting an ejection state and adhesion of the ink to the ejection face.

In accordance with setting by the CPU 121 via the CPU buses 121*a* to 121*c*, the ejection controller 122 produces a head control signal 122*c* transmitted through four signal lines, which is required to transfer the image control signals 121*d* to 121*g* to the ink jet print head. Additionally, the ejection controller 122 outputs to the correction circuit 123, a correction synchronization clock 122*a* and an ejection synchronization signal 122*b* in synchronism with the VE* signal 121*e*.

The correction circuit 123 receives a signal (hereafter referred to as an "ink ejection/ink adhesion detection signal") 112*a* output by the light receiving section 112 of the unit 11 and used to detect the presence of ejected ink droplet and adhesion of the ink to the ejection face, increases the S/N ratio, and accurately detects an ink ejection state and adhesion of the ink to the ejection face in synchronism with the correction synchronization clock 122*a* and ejection synchronization signal 122*b* from the ejection controller 122. The correction circuit 123 then delivers the detected data to the CPU buses 121*a* to 121*c* in accordance with access timings provided by the CPU 121. In addition, for the adhesion of the ink to the ejection face, the correction circuit outputs a time-over interruption signal 123*a* and/or a level-over interruption signal 123*b* to the CPU 121.

On receiving the interruption signals 123*a*, 123*b*, the CPU 121 allows the ejection face to be wiped after the ejection failure detection sequence is finished, and then enters the ejection failure detection sequence again. The CPU 121 also compares the data in the storage unit 124 that stores the previous ink ejection state, with data including the current ink ejection state and considerations for the time-over and level-over interrupts. If the CPU 121 judges that an ejection failure is occurring at the same ejection opening or an ejection opening in a neighborhood thereof, it further determines that this failure originates from adhesion of the ink to the ejection face and allows this data to be stored in the storage unit 124. Such a control method will be described later.

During the operation of detecting an ejection state or adhesion of the ink to the ejection face, the light emitting section 111 irradiates the light receiving section 112 with a laser beam. In this example, a semiconductor laser and an optical system (not shown) including lenses are used to generate parallel beams so that a uniform luminous flux of the light beams 111*a* extend to the light receiving section 112.

The plurality of nozzles (in this example, for explanation, 16 nozzles labeled 1N to 16N and formed from one end to the other end of the arrangement range) arranged in the ink jet print head 113 sequentially eject the ink, for example, in the form of droplets (labeled 113*a* to 113*p*) to block the light beam 111*a* in order to allow the determination of the ink droplet ejection state of each nozzle. Then, based on the time passing while the light beam 111*a* is blocked or on an output value, it is determined whether or not the ink adheres to the ejection face.

The ink jet print head 113 used herein is based on the use of thermal energy for ink ejection and has electrothermal transducers (ejection heaters) mounted at the nozzles so that when the heaters are powered on, film boiling occurs in the ink, which is thus ejected.

(Details of the Ejection Controller)

Figure 3:
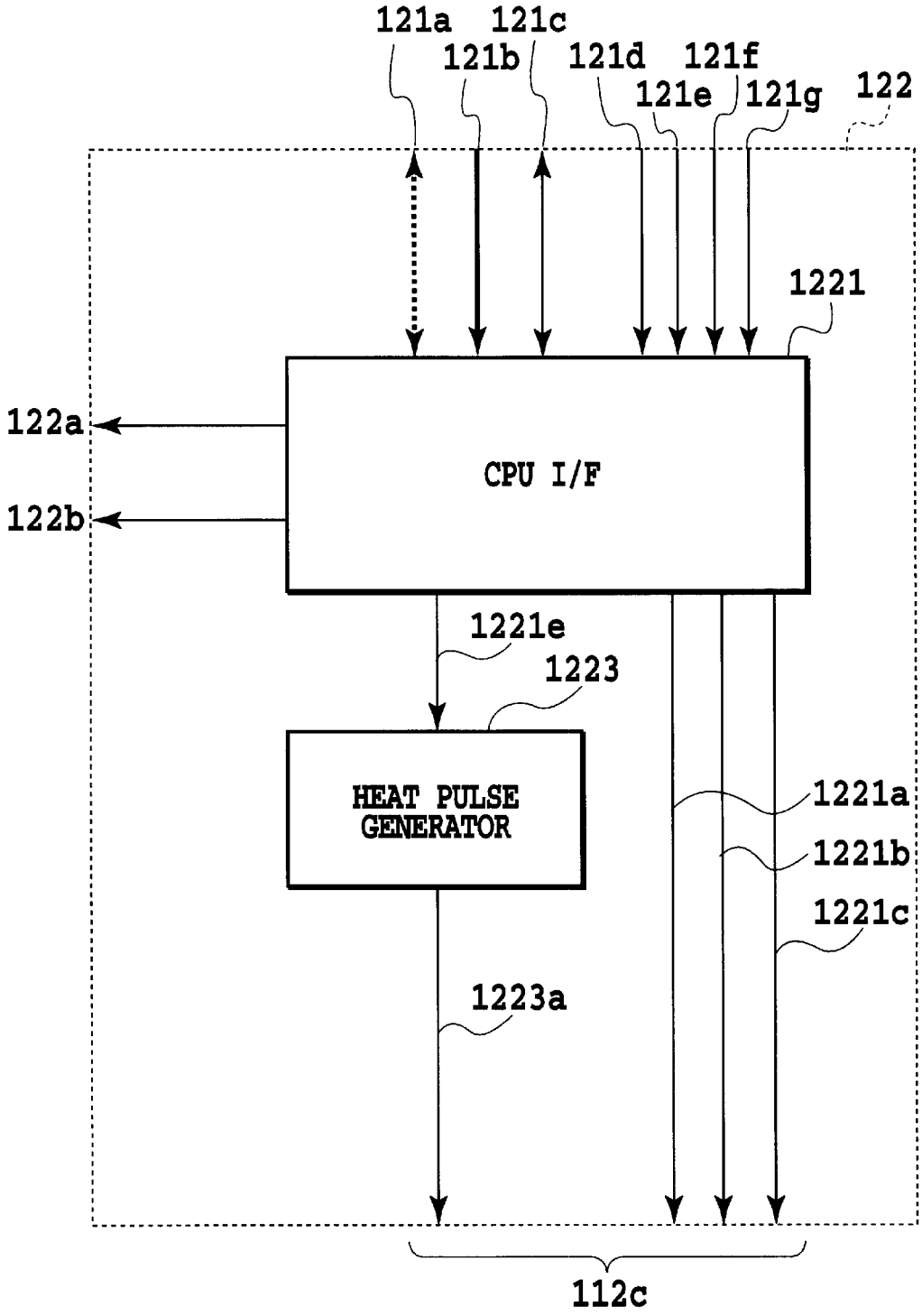
FIG. 3 is a block diagram showing an example of an internal configuration of an ejection controller in FIG. 2.

FIG. 3 is a block diagram showing an example of internal configuration of the ejection controller 122. A heat pulse generator 1223 produces control signals for the ink jet print head 113 during image data printing. A CPU interface (I/F) 1221 uses a bus connection with the CPU 121 to carry out processes (1) to (4) required for ejection control, which will be described next, produces image transfer signals for the ink jet print head, and produces control signals for the correction circuit 123.

(1) Process for setting a heat pulse for the heat pulse generator 1223:

A double pulse that is a heat pulse provided during normal printing is set by a setting signal (1221*e*). The heat pulse width set by this signal is for an ejection possible range.

(2) Process for generating data transfer signals 1221*a* to 1221*c* for the ink jet print head based on the image control signals 121*d* to 121*g* from the CPU 121:

In this case, the data transfer signal 1221*a* is an image signal (16 data in total for the 16 nozzles), the data transfer signal 1221*b* is a synchronization clock, and the data transfer signal 1221*c* is a latch signal. At a rising edge of the synchronization clock 1221*b*, the image signal 1221*a* is transferred to a shift register (not shown) for the ink jet print head 113. Then, the latch signal 1221*c* causes a latch circuit in the head 113 to latch the image signal 1221*a*, and an ejection pulse signal 1222*a* or 1223*a* causes the ink to be ejected. The data transfer signals 1221*a* to 1221*c* are generated based on the reference signal from the encoders 6, 7 for monitoring the position of the ink jet print head 113 as described above, and these signals determine which data to print and where to print this data.

(3) Process for producing the clock signal 122*a* for the correction circuit 123:

This clock signal is asynchronous with an image transfer clock and has a fourfold higher frequency than it.

(4) Process for producing the VE* signal 122*b* for the correction circuit 123:

This synchronization signal is synchronous with the VE* signal 121*e* and is output simultaneously with an ejection pulse signal 1224*a* output from a selector 1224.

(Details of the Correction Circuit)

Figure 4:
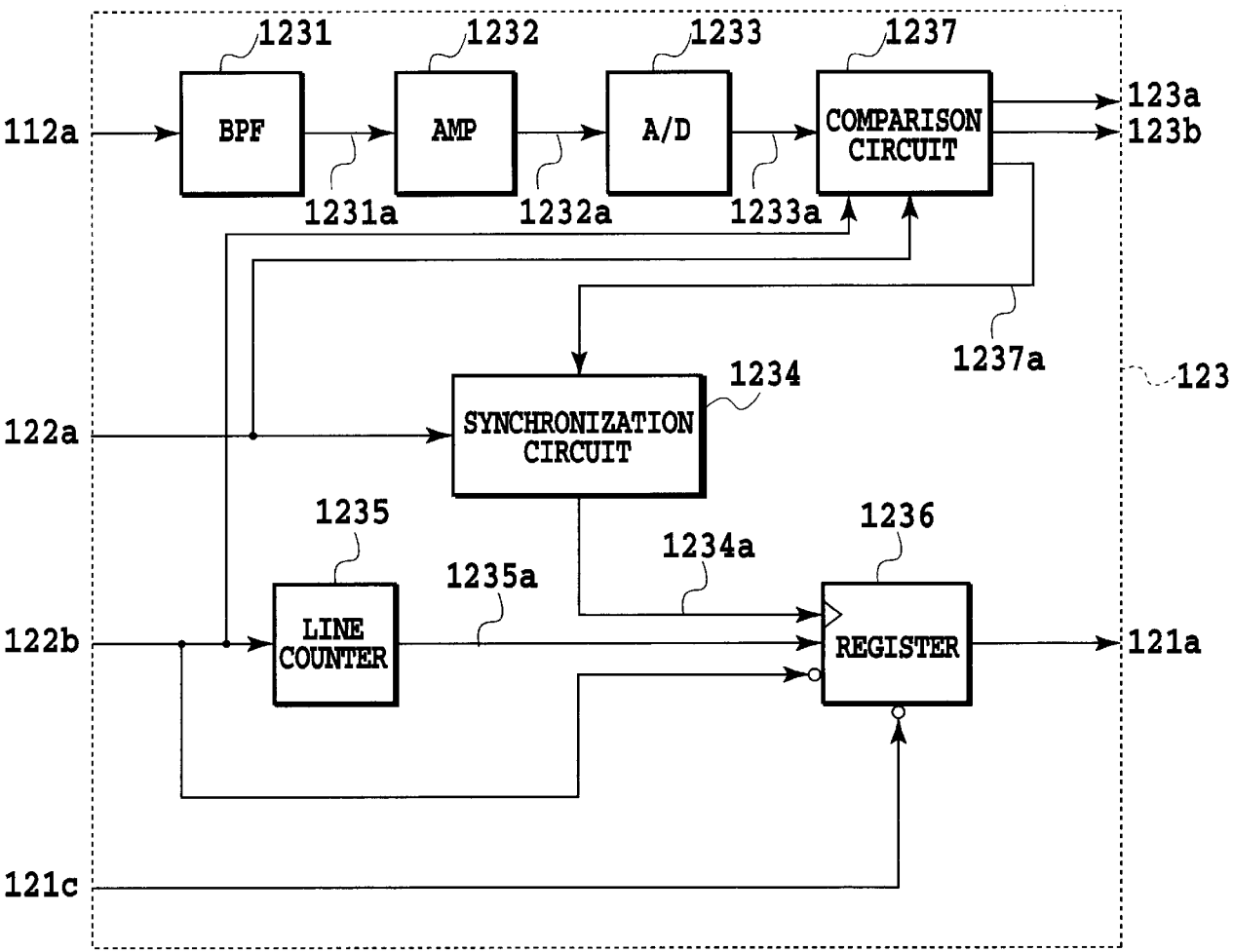
FIG. 4 is a block diagram showing an example of a configuration of a correction circuit in FIG. 2.

FIG. 4 is a block diagram showing an example of an internal configuration of the correction circuit 123. A bandpass filter (BPF) 1231 improves the SIN ratio of the ink ejection/ink adhesion detection signal 112*a* from the light receiving section 112 and extracts the characteristics thereof. An amplifier (AMP) 1232 amplifies a faint signal 1231*a* with the extracted characteristics so that an A/D converter 1233 can convert an amplified signal 1232*a* into a digital signal 1233*a*.

The digitized ink ejection/ink adhesion detection signal 1233*a* is input to a comparison circuit 1237. The comparison circuit 1237 sends out a digitized ink ejection/ink adhesion detection signal 1237*a* to a synchronization circuit 1234, and sends out to the CPU 121 the time-over interruption signal 123*a* or level-over interruption signal 123*b*, which is the ejection face ink adhesion detection signal, if the signal 1233*a* exceeds a specified value or lasts longer than a specified length of time.

The digitized ink ejection/ink adhesion detection signal 1237*a* that has passed through the comparison circuit 1237 is then shaped in the synchronization circuit 1234 by the clock signal 122*a* from the ejection controller in order to remove meaningless noise signals (spike noise or the like). A shaped ink ejection/ink adhesion detection signal 1234*a* is input to a latch clock in a register 1236, whereas a count signal 1235*a* from a line counter 1235 is set in the register 1236, the line counter 1235 counting the order of ink droplet ejections. The data set in the register 1236 is output to the data bus 121*a* in response to an output signal transmitted from the CPU 121 via the control bus 121*c*. The register 1236 is cleared by the ejection count signal 122*b* on each ejection. Thus, when ink droplet is ejected, the register 1236 outputs a corresponding nozzle number, whereas when an ejection failure occurs, it outputs "0".

(Timing Chart for the Correction Circuit)

Figure 5:
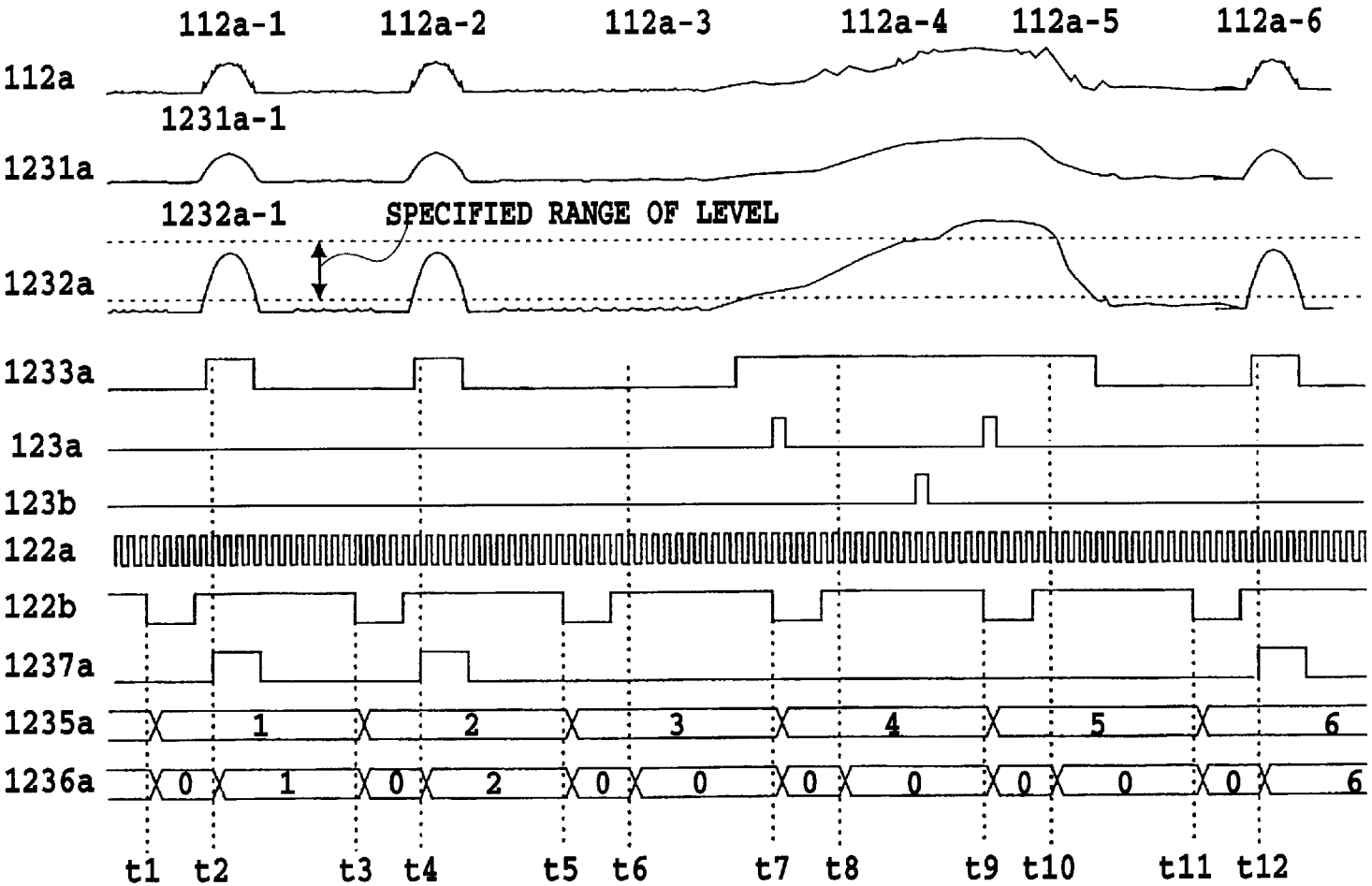
FIG. 5 is a timing chart useful in describing signal processing carried out by the correction circuit shown in FIG. 4.

FIG. 5 shows how in the ejection failure detection mode, the correction circuit 123 processes the interruption signals arising from the detection of the ejection of ink droplet and the detection of adhesion of the ink to the ejection face. The figure shows the ejection detection signal 112*a* from the light receiving section 112, the signal 1231*a* output from the bandpass filter 1231 after filtering, the amplified signal 1232*a* from the amplifier 1232, the digitized signal 1233*a* from the A/D converter 1233, the ejection face ink adhesion interruption signal 123*a* output from the comparison circuit 1237 due to time-over, the ejection face ink adhesion interruption signal 123*b* arising from level-over, the ink droplet detection signal 1237*a*, the clock signal 122*a* output to the synchronization circuit 1234 and the comparison circuit 1237, the output signal 1234*a* from the synchronization circuit 1234, the ejection count signal 122*b* input to the line counter 1235 and the comparison circuit 1237, the count data 1235*a* in the ejection count signal 122*b* from the line counter 1235, and ejection detection data 1236*a* latched in the register 1236 in response to the output signal 1234*a* from the synchronization circuit 1234.

For the ejection detection signal 112*a*, ejection detection signals for each nozzle are sequentially output starting with a first nozzle. Reference numeral 112*a*-1 denotes an ink droplet ejection detection signal for the first nozzle, reference numeral 112*a*-2 denotes an ink droplet ejection detection signal for a second nozzle, reference numeral 112*a*-3 denotes an ink droplet ejection detection signal for a third nozzle, reference numeral 112*a*-4 denotes an ink droplet ejection detection signal for a fourth nozzle, reference numeral 112*a*-5 denotes an ink droplet ejection detection signal for a fifth nozzle, and reference numeral 112*a*-6 denotes an ink droplet ejection detection signal for a sixth nozzle. The figure shows that the first, second, and sixth nozzles have ejected the ink successfully, that the third nozzle has failed to eject the ink, and that the fourth and fifth nozzles have failed to eject the ink because of adhesion of the ink to the ejection face.

Since the ejection detection signal 112*a* contains noise components, these components are filtered by the filter 1231 to generate the filtered signal 1231*a*. The filtered signal 1231*a*, however, has a low voltage level and is thus unsuitable for the processing in the CPU 121. Accordingly, this signal is amplified by the amplifier 1232 to obtain the amplified signal 1232*a*. The amplified signal 1232*a* is digitized by the A/D converter 1233 and then input to the comparison circuit 1237 as the signal 1233*a*. The time and level of the input signal are compared with specified values, and if they do not correspond with these values, the interruption signals 123*a* and 123*b* for the time and the level, respectively, are returned to the CPU 121. The ink droplet detection signal 1237*a* including considerations for the interruption signals 123*a*, 123*b* is input to the synchronization circuit 1234. The synchronization circuit 1234 uses the synchronization clock 122*a* produced by the ejection controller, to shape the digitized detection signal 1237*a*. That is, unwanted components such as spike noise are removed from the digitized detection signal 1237*a* to obtain the detection signal 1234*a*, which is more accurate. The detection signal 1234*a* is input to the register 1236.

Actual ink droplet ejection will sequentially be described with reference to FIG. 5.

Point of time t1: The ejection count signal 122*b* is input to the line counter 1235 to increment the count value to set the count data 1235*a* at "1". At the same time, the ejection count signal 122*b* is also input to a clear terminal of the register 1236 to clear the ejection detection data 1236*a* to "0".

Point of time t2: When an ink droplet from the first nozzle is detected at a rising edge of the synchronization signal 1234*a*, the value "1" of the count data 1235*a* is latched in the register 1236. The ejection detection data 236*a*, that is, the latched data, is changed from "0" to "1", so that the detection of ink droplet from the first nozzle is communicated to the CPU 121 via the data bus 121*a*.

Point of time t3: The ejection count signal 122*b* increments the count value of the line counter 1235 to make the count data 1235*a* to "2". At the same time, the ejection detection data 1236*a* in the register 1236 is cleared to "0".

Point of time t4: When an ink droplet from the second nozzle is detected at a rising edge of the synchronization signal 1234*a*, the value "2" of the count data 1235*a* is latched in the register 1236. The ejection detection data 1236*a*, that is, the latched data, is changed from "0" to "2", so that the detection of ink droplet from the second nozzle is communicated to the CPU 121 via the data bus 121*a*.

Point of time t5: The ejection count signal 122*b* increments the count value of the line counter 1235 to make the count data 1235*a* to "3". At the same time, the ejection detection data 1236*a* in the register 1236 is cleared to "0".

Point of time t6: Since the synchronization signal 1234*a* is not a state of an ink droplet detection and has no rising edge, the value "3" of the count data 1235*a* cannot be latched in the register 1236. The ejection detection data 1236*a*, that is, the latched data, is unchangeably kept at "0", so that the non-detection of ink droplet from the third nozzle, i.e., an ejection failure is communicated to the CPU 121 via the data bus 121*a*.

Point of time t7: The ejection count signal 122*b* increments the count value of the line counter 1235 to make the count data 1235*a* to "4". At the same time, the ejection detection data 1236*a* in the register 1236 is cleared to "0".

Point of time t8: Since the synchronization signal 1234*a* is not a state of an ink droplet detection and has no rising edge, the value "4" of the count data 1235*a* cannot be latched in the register 1236. The ejection detection data 1236*a*, that is, the latched data, is unchangeably kept at "0", so that the non-detection of ink droplet from the fourth nozzle, i.e., an ejection failure is communicated to the CPU 121 via the data bus 121*a*.

Point of time t9: The ejection count signal 122*b* increments the count value of the line counter 1235 to make the count data 1235*a* to "5". At the same time, the ejection detection data 1236*a* in the register 1236 is cleared to "0".

Point of time t10: Since the synchronization signal 1234*a* is not a state of an ink droplet detection and has no rising edge, the value "5" of the count data 1235*a* cannot be latched in the register 1236. The ejection detection data 1236*a*, that is, the latched data, is unchangeably kept at "0", so that the non-detection of ink droplet from the fifth nozzle, i.e., an ejection failure is communicated to the CPU 121 via the data bus 121*a*.

Point of time t11: The ejection count signal 122*b* increments the count value of the line counter 1235 to make the count data 1235*a* to "6". At the same time, the ejection detection data 1236*a* in the register 1236 is cleared to "0".

Point of time t12: When an ink droplet from the sixth nozzle is detected at a rising edge of the synchronization signal 1234*a*, the value "6" of the count data 1235*a* is latched in the register 1236. The ejection detection data 1236*a*, that is, the latched data, is changed from "0" to "6", so that the detection of ink droplet from the second nozzle is communicated to the CPU 121 via the data bus 121*a*.

(Ejection Failure Detection Operation Based on the Relative Position of a Luminous Flux)

Figure 6:
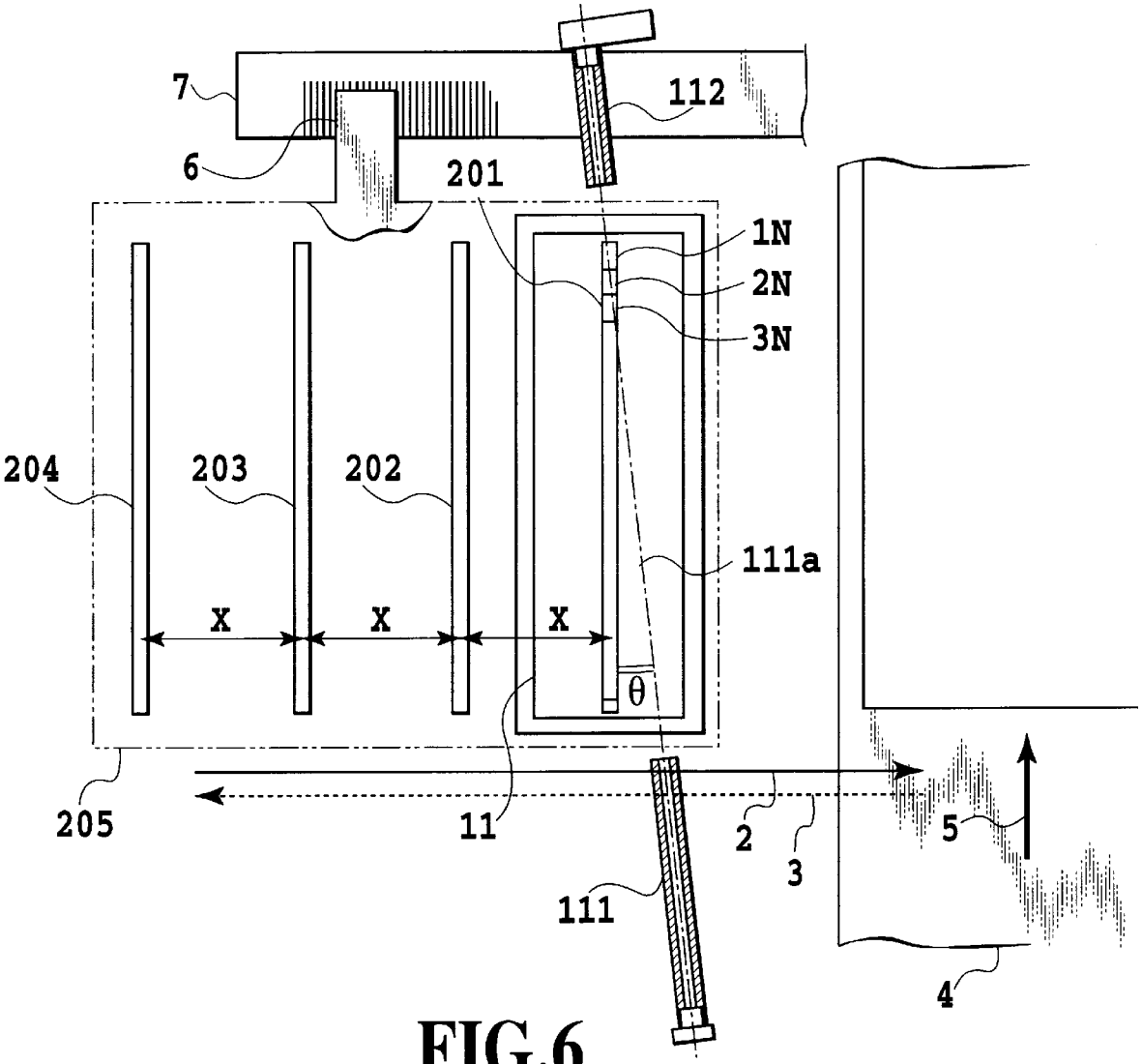
FIG. 6 is an explanatory drawing schematically showing the relative positions of a head and a laser beam for ink droplet detection during ejection failure-detecting operations in the apparatus in FIG. 1.

FIG. 6 schematically represents the relative positions of the head during the ejection failure detection operation and of a laser beam for ink droplet detection. In the figure, the ink jet print head 113 is illustrated from its top surface. Nozzle arrays 201 to 204 of a plurality of print heads are illustrated for convenience. The main scanning is performed with the range of the nozzle array, and an image is formed. In this figure, the nozzle arrays 202 to 204 of the other ink jet print heads, which are not shown in FIG. 1, include nozzles for ejecting inks of the primary colors for color printing, that is, cyan, magenta, and yellow. The distance between the adjacent nozzle arrays agree with the disposition pitch X of the heads (the interval between the heads on a carriage) in the main scanning direction.

Reference numeral 205 designates a carriage including the four ink jet print heads for ejecting the corresponding color inks. The carriage 205 is moved in the main scanning direction for printing. Printing executed by moving the carriage 205 in the direction of the arrow 2 is hereafter referred to as "forward printing", while printing executed by moving the carriage in the direction of the arrow 3 is hereafter referred to as "backward printing".

As shown in this figure, the laser beam 111*a* output from the light emitting section 111 traverses the landing range 201 in the head 113 at an angle θ, and the light receiving section 112 detects ink droplets ejected from the head during it is moving. The ink droplet detection operation is similarly performed on the three subsequent heads.

(Detection of an Ejection Failure during Forward Main Scanning)

Figure 7:
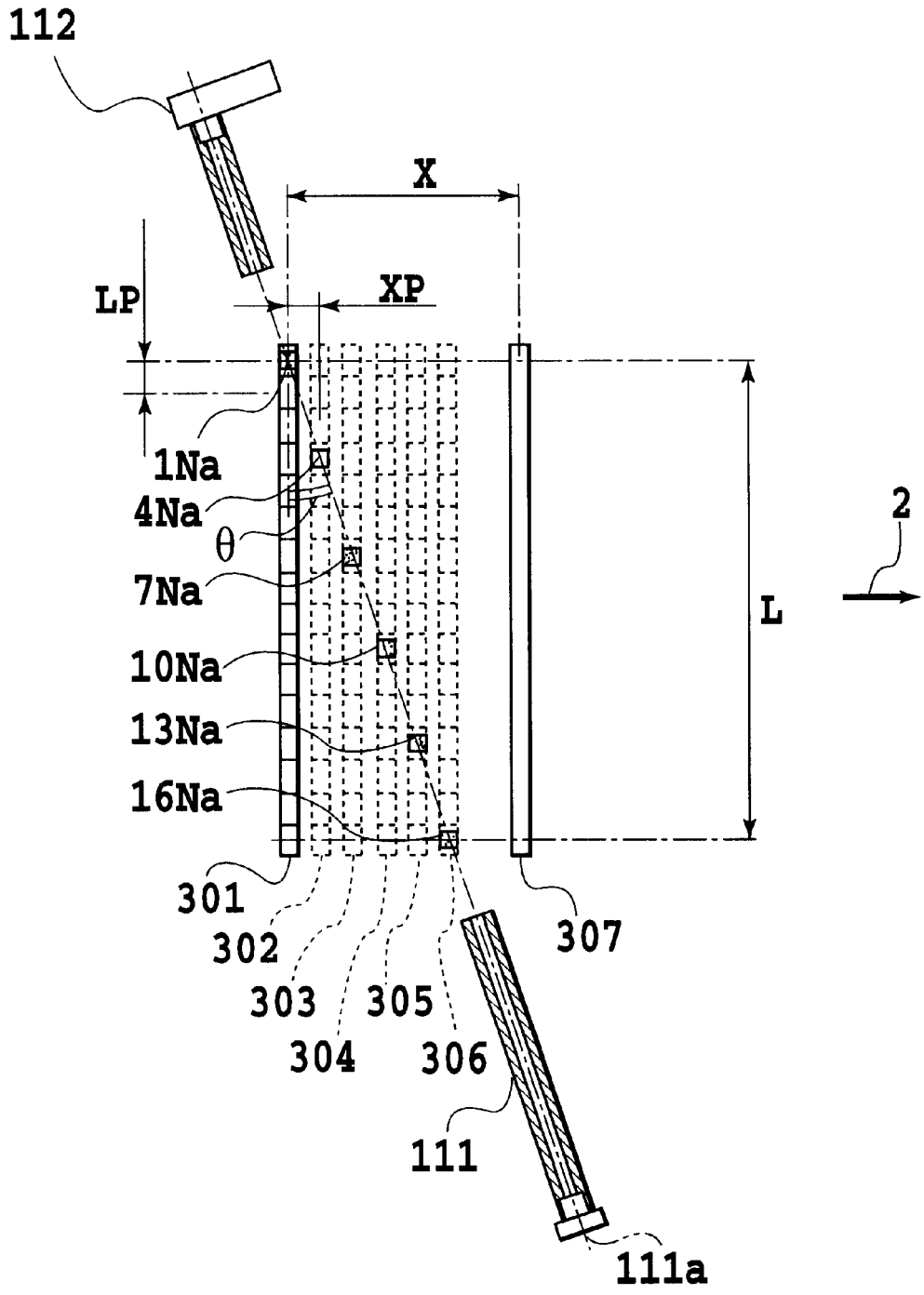
FIG. 7 is a diagram useful in describing detection of an ejection failure during forward main scanning within the series of ejection failure detecting operations according to an embodiment of the present invention.

FIG. 7 shows how an ejection failure is detected during forward main scanning. In the FIGS., 1Na, 4Na, 7Na, 10Na, 13Na, and 16Na denote landing positions of ink droplets ejected from the nozzles IN, 4N, 7N, 10N, 13N, and 16N. First, at a position of column 301, the ink jet print head 113 ejects the ink through the nozzle 1N. An ink droplet reaching the position 1Na is ejected so as to traverse the center of the laser beam 111*a*, by appropriately controlling the ejection timing thereof. While the head is moving in the forward main-scanning direction 2, each of the nozzles 4N, 7N, . . . sequentially eject corresponding ink droplet, and each of which is ejected to pass through the center of the laser beam in each case, by appropriately controlling each of ejection timings. During these operations, the head sequentially moves to the positions of columns shown by reference numerals 302, 303, 304, 305, 306, and an ejection failure can be detected by monitoring ink ejection state from the six nozzles in the head. After the processing for the ink jet print head 113 has been completed, when the head (for example, the head having the nozzle array 201) reaches a position of column 307, similar detection control shifts to the adjacent head (for example, the head having the nozzle array 202). While moving in the forward main-scanning direction, each nozzle of each head has sequentially subjected to the ink droplet detection process.

The pitch (XP) between the adjacent positions within the positions of columns 301 to 306 corresponds to a print resolution of 360 dpi (dots/inch) and to an interval of 70.5 μm. The interval (LP) between the adjacent nozzles within the nozzles 1N to 16N is also 70.5 μm. The irradiation angle of the laser beam, which is limited to the adjacent-head interval (X), is θ with respect to the heads. This inclination enables the plurality of heads to have their ejection states continuously detected during movement. In this case, θ is about 18.4°.

In this example, the ink droplet detection operation is performed at intervals of three nozzles; this is a restriction resulting from the movement speed of the carriage 205 in the forward main-scanning direction. In a printing operation on an actual printing medium, the carriage 305 moves at 400 mm/s and the ink droplet ejection cycle of the print head is 176 μs, so that the above interval condition is obtained from the following conditions:

In general, if N: total number of nozzles in the head;

X: adjacent-head interval (head disposition pitch);

V: main-scanning movement speed;

T: main-scanning ink droplet ejection cycle;

XP: adjacent-column pitch;

LP: adjacent-nozzle pitch;

L: distance between the first nozzle and the last nozzle in the head; and

θ: angle between the head and the luminous flux, then the following relations are established:

ejection nozzle interval: $Y=INT\{[(N\div INT(X\div(VT))]+1\}$;

luminous-flux-head angle: $\theta=1/Y \leqq (X-XP)/P$; and head print width: $L=(N-1)P$.

FIG. 7 shows that the ejection nozzle interval Y is "3". In this case, all the 16 nozzles can be detected using a series of detection sequences based on three main scanning operations, including an ejection failure detection sequence with backward main scanning, which will be described next, and a subsequent ejection failure detection sequence with forward main scanning.

(Detection of an Ejection Failure during Backward Main Scanning)

Figure 8:
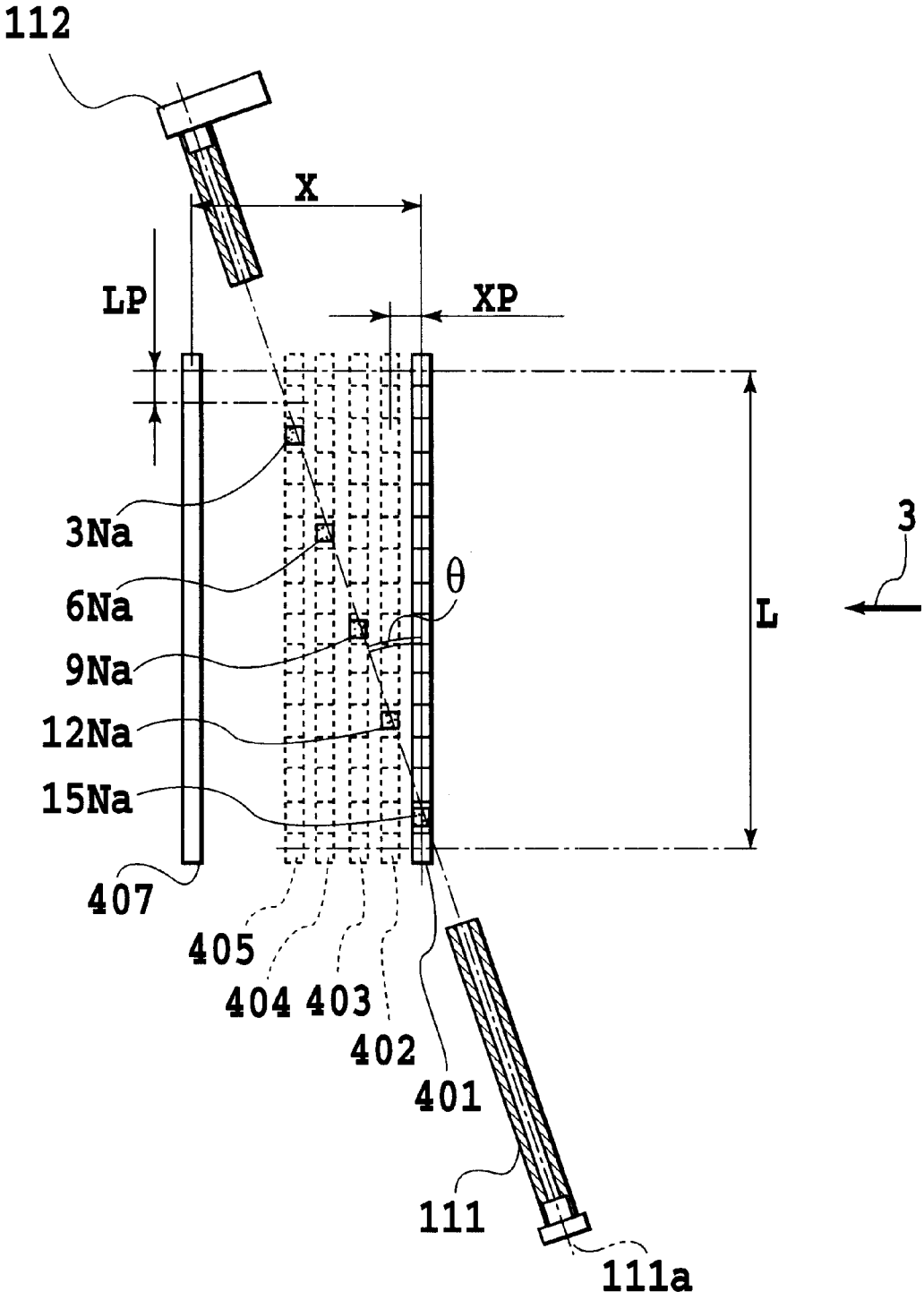
FIG. 8 is a diagram useful in describing detection of an ejection failure during backward main scanning within the series of ejection failure detecting operations according to an embodiment of the present invention.

FIG. 8 shows how an ejection failure is detected during backward main scanning. In the figure, 15Na, 12Na, 9Na, 6Na and 3Na denote landing positions of ink droplets ejected from the nozzles 15N, 12N, 9N, 6N and 3N. First, at a position of column 401, the ink jet print head 113 ejects the ink through the nozzle 15N. An ink droplet reaching the position 15Na is ejected so as to traverse the center of the laser beam 111*a*, by appropriately controlling the ejection timing thereof. While the head is moving in the backward main-scanning direction 3, each of the nozzles 12N, 9N, . . . sequentially eject corresponding ink droplet, and each of which is ejected to pass through the center of the laser beam in each case, by appropriately controlling each of ejection timings. During these operations, the head sequentially moves to the positions of columns shown by reference numerals 402, 403, 404, 405, and an ejection failure can be detected by monitoring ink ejection state from the six nozzles in the head. After the processing for the ink jet print head 113 has been completed, when the head (for example, the head having the nozzle array 202) reaches a position of column 407, similar detection control shifts to the adjacent head (for example, the head having the nozzle array 201). While moving in the forward main-scanning direction, each nozzle of each head has sequentially subjected to the ink droplet detection process.

The pitch (XP) between the adjacent positions within the positions of columns 401 to 405 corresponds to a print resolution of 360 dpi and to an interval of 70.5 μm. The interval (LP) between the adjacent nozzles within the nozzles 1N to 16N is also 70.5 μm. The irradiation angle of the laser beam, which is limited to the adjacent-head interval (X), is 0 with respect to the heads. This inclination enables the plurality of heads to have their ejection states continuously detected during movement. In this case, θ is about 18.4°. These are similar to the above detection sequence of the ejection failure during the forward main scanning.

The ink droplet detection operation is also performed at intervals of three nozzles but detects those nozzles that have not been undergone the detection sequence with the forward main scanning. Subsequently, the detection sequence with the second forward main scanning (corresponding to the nozzles 2N, 5N, 8N, 11N, 14N) is further carried out, and the detection process for all nozzles is completed during the three detection sequences based on the forward and backward scanning. The backward main-scanning detection can also be executed at the carriage speed of actual printing operations.

(Timing Chart for Ejection Failure Detection during Forward Main Scanning)

Figure 9:
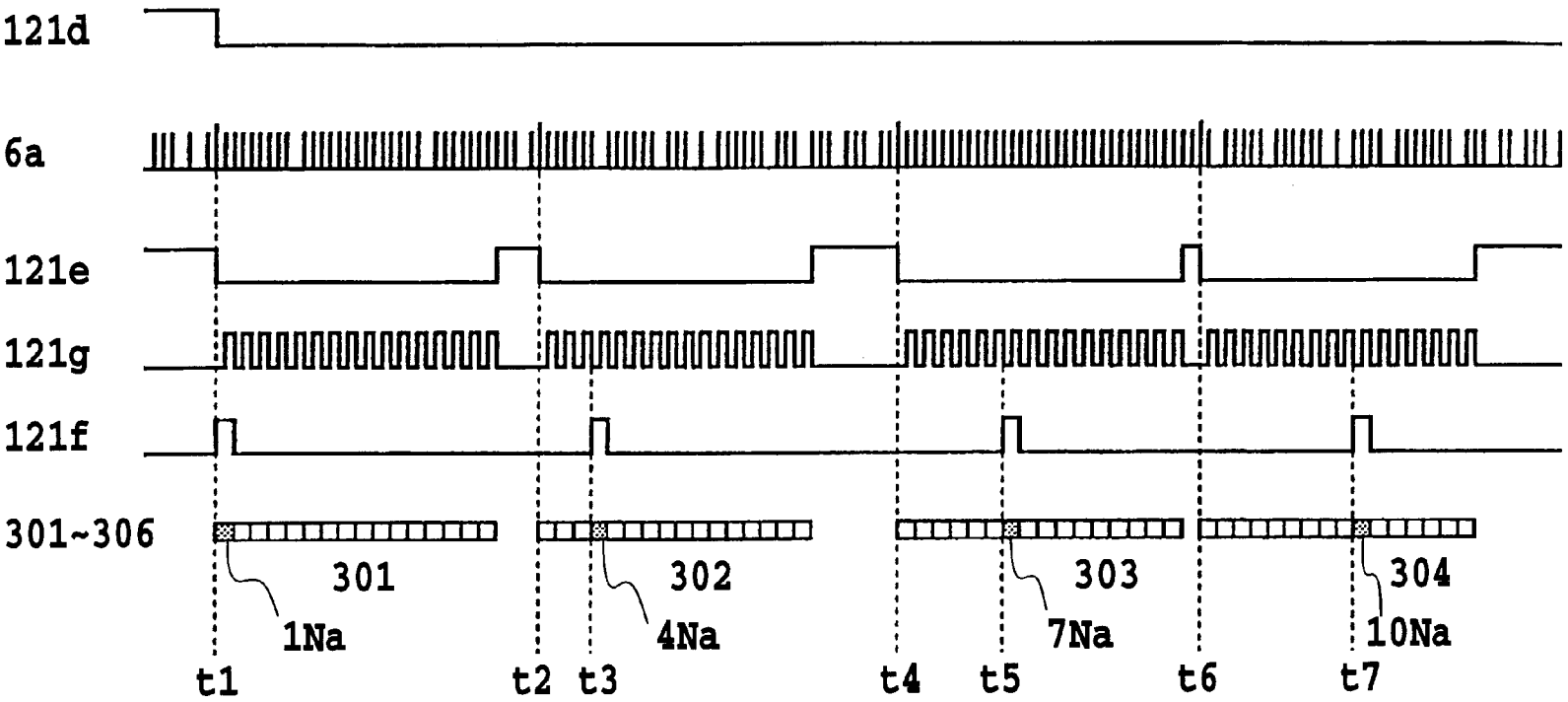
FIG. 9 is a timing chart useful in describing the detection of an ejection failure during the forward main scanning shown in FIG. 7.

FIG. 9 is a timing chart for the ejection failure detection operation with the forward main scanning. In this figure, reference numeral 121*d* denotes the BVE* signal indicative of an effective image area in the main scanning direction of the ink jet print head 113 that carries out printing based on the serial scan method, reference numeral 121*e* denotes the VE* signal indicative of an effective image area of the ink jet print head 113 in a nozzle column direction, reference numeral 121*f* denotes the image signal for causing the ink to be ejected from the ink jet print head, reference signal 121*g* denotes the transfer synchronization clock for the image signal, and reference numeral 6*a* denotes the reference signal from the encoder (6, 7) for monitoring the position of the ink jet print head 113. The four signals 121*d*, 121*e*, 121*f*, 121*g* are generated based on the reference signal 6*a* to control which data to print and where to print this data. In addition, the columns 301 to 304 showing ink ejection or landing states used for producing ejection failure detection signals during forward main scanning in FIG. 7 are schematically arranged on this timing chart, and the positions of the nozzles driven for ejection by the control signals are represented on these columns (the hatched portions).

Once the encoder signal 6*a* has been output for a predetermined number (in this case, 34) of pulses (the point of time t1), the signal 121*d* becomes active (L level in negative logical operations; This also applies to the following description.) to start first sequence control for the ejection failure detection sequence during the forward main scanning. At the same time, the ejection enable signal 121*e* for the first line of the ink jet print head 113 becomes active (L level) to transfer the data 121*f* for the first nozzle IN with the image transfer synchronization clock 121*g* in order to eject the ink at the position 1Na of the column 301. The ejection control for the column 301 is completed after control of the 16 nozzles. The process then waits for ejection control for the next column.

The ejection control for the column 302 is started at the point of time t2 when the encoder pulse 6*a* starting from the starting point t1 of the last column has reached "34". As in the control for the column 301, the ejection enable signal 121*e* for the column 302 of the ink jet print head 113 becomes active (L level) to transfer the data 121*f* for the fourth nozzle 4N with the image transfer synchronization clock 121*g* in order to eject the ink at he position 4Na of the column 302. The ejection control or the column 302 is completed after control of the 16 nozzles. The process then waits for ejection control for the next column.

In this manner, the ejection failure detection data s sequentially obtained from the predetermined nozzle to complete the first sequence. As seen in the figure, this ejection control is carried out at intervals of a fixed count value for the encoder synchronization signal 6*a* to prevent the ink landing positions for each column from deviating due to non-uniform transfer by a drive motor (not shown) for the carriage 205.

(Timing Chart for Ejection Failure Detection during Backward Main Scanning)

Figure 10:
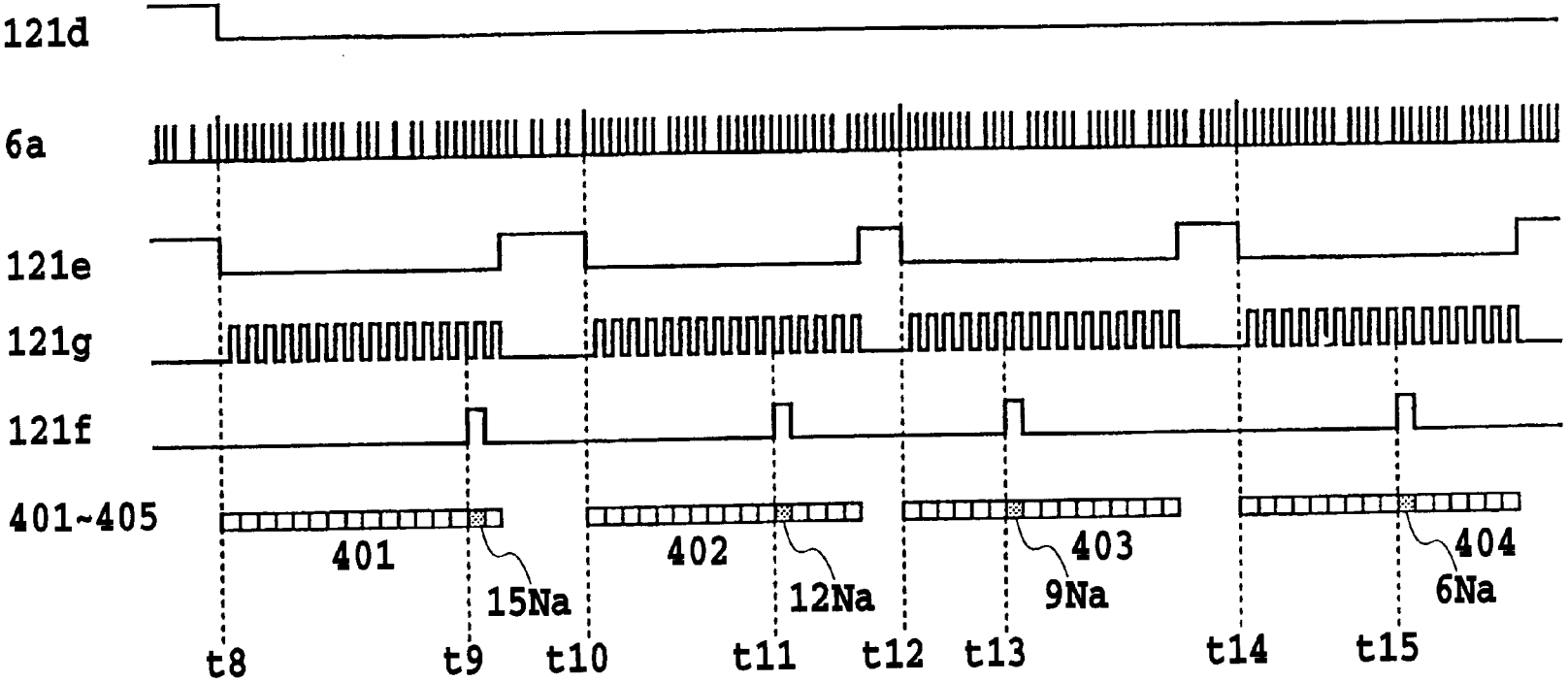
FIG. 10 is a timing chart useful in describing the detection of an ejection failure during the backward main scanning shown in FIG. 8.

FIG. 10 is a timing chart for the ejection failure detection operation with the backward main scanning. The columns 401 to 404 showing ink ejection or landing states used for producing ejection failure detection signals during backward main scanning in FIG. 8 are schematically arranged on this timing chart, and the positions of the nozzles driven for ejection by the control signals are represented on these columns (the hatched portions).

Once the encoder signal 6*a* has been output for a predetermined number (in this case, 34) of pulses (the point of time t8), the signal 121*d* becomes active (L level) to start second sequence control for the ejection failure detection sequence during the backward main scanning. At the same time, the ejection enable signal 121*e* for the first line of the ink jet print head 113 becomes active (L level) to transfer the data 121*f* for the fifteenth nozzle 15N with the image transfer synchronization clock 121*g* in order to eject the ink at the position 15Na of the column 401. The ejection control for the column 401 is completed after control of the 16 nozzles. The process then waits for ejection control for the next column.

The ejection control for the column 402 is started at the point of time t10 when the encoder pulse 6*a* starting from the starting point t8 of the column 401 has reached "34". As in the control for the column 401, the ejection enable signal 121*e* for the column 402 of the ink jet print head 113 becomes active (L level) at the point of time t10 to transfer the data 121*f* for the twelfth nozzle 12N with the image transfer synchronization clock 121*g* in order to eject the ink at the position 12Na of the column 402. The ejection control for the column 402 is completed after control of the 16 nozzles. The process then waits for ejection control for the next column. In this manner, the ejection failure detection data is sequentially obtained from the predetermined nozzle to complete the second sequence.

As seen in the figure, this ejection control is carried out at intervals of a fixed count value for the encoder synchronization signal 6*a* to prevent the ink landing positions for each column from deviating due to non-uniform transfer by a drive motor (not shown) for the carriage 205.

The third sequence for the nozzles 2N, 5N, 8N, 11N, 14N is carried out as the forward ejection failure detection sequence again. The above three sequences complete the ejection failure detection for all the 16 nozzles.

(Timing Chart for Normal Printing during the Forward Main Scanning)

Figure 11:
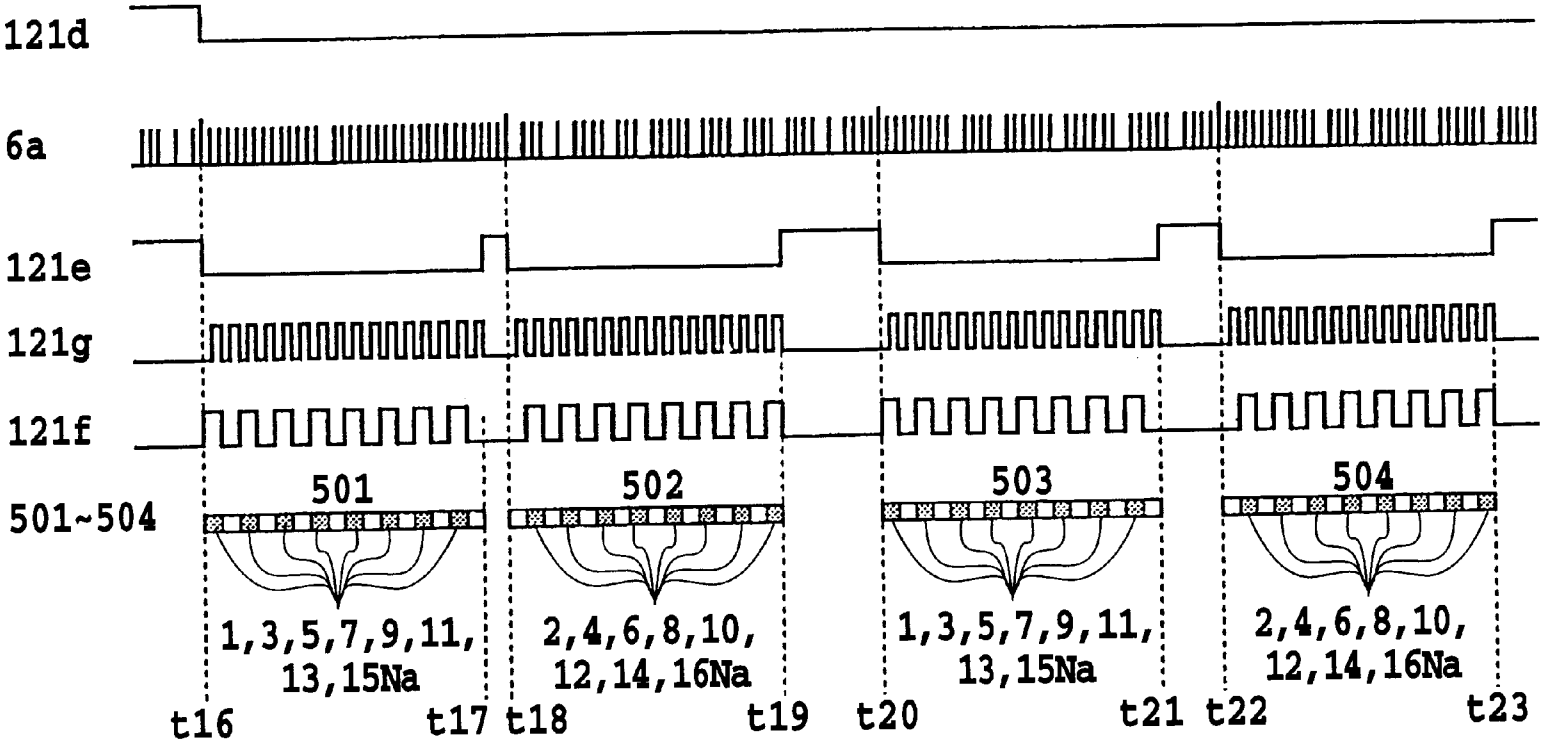
FIG. 11 is a timing chart useful in describing a forward main-scanning operation performed during normal printing.

FIG. 11 is a timing chart showing the operation of normal printing carried out during the forward main scanning, that is, forward printing. Columns 501 to 504 showing ink ejection or landing states resulting from the normal print signal during the forward main scanning are schematically arranged on this timing chart, and the positions of the nozzles driven for ejection by the print signals are represented on these columns (the hatched portions). This figure shows that in the columns 501, 503, the odd-number-th nozzles are driven for ejection, while in the columns 502, 504, the even-number-th nozzles are driven for ejection. During the forward main scanning, data masked with a checker or lattice pattern is formed on the printing medium 4.

Once the encoder signal 6*a* has been output for a predetermined number (in this case, 34) of pulses (the point of time t16), the signal 121*d* becomes active (L level) to start first sequence control for the normal printing during the forward main scanning. At the same time, the ejection enable signal 121*e* for the column 501 of the ink jet print head 113 becomes active (L level) to transfer the data 121*f* for the first nozzle 1N, the third nozzle 3N, the fifth nozzle 5N, the seventh nozzle 7N, . . . , the fifteenth nozzle 15N with the image transfer synchronization clock 121*g* at the point of time t17 in order to eject the ink at the positions 1Na, 3Na, 5Na, 7Na, . . . , 15Na of the column 501. The ejection control for the column 501 is completed after control of the 16 nozzles. The process then waits for ejection control for the next column.

The ejection control for the column 502 is started at the point of time t18 when the encoder pulse 6*a* starting from the starting point t16 of the last column has reached "34". As in the control for column 501, the ejection enable signal 121*e* for the column 502 of the ink jet print head 113 becomes active (L level) at the point of time t18 to transfer the data 121*f* for the second nozzle 2N, the fourth nozzle 4N, the sixth nozzle 6N, the eighth nozzle 8N, . . . , the sixteenth nozzle 16N with the image transfer synchronization clock 121*g* at the point of time t19 in order to eject the ink at the positions 2Na, 4Na, 6Na, 8Na, . . . , 16Na of the column 502. The ejection control for the column 502 is completed after control of the 16 nozzles. The process then waits for ejection control for the next column.

In this manner, the normal ejection data is sequentially printed by the predetermined nozzle to complete the first forward-normal-printing ejection sequence. As seen in the figure, this ejection control is carried out at intervals of a fixed count value for the encoder synchronization signal 6*a* to prevent the ink landing positions for each column from deviating due to non-uniform transfer by a drive motor (not shown) for the carriage 205.

The illustrated forward-normal-printing ejection sequence uses the same controls as the forward ejection failure detection sequence described in FIG. 9, except for the ejection data. The backward-normal-printing ejection sequence also uses the same controls as the backward ejection failure detection sequence described in FIG. 10, except for the ejection data. Images are printed by these complementary printing operations during the forward and backward main scannings.

(Control Procedure)

Figure 12:
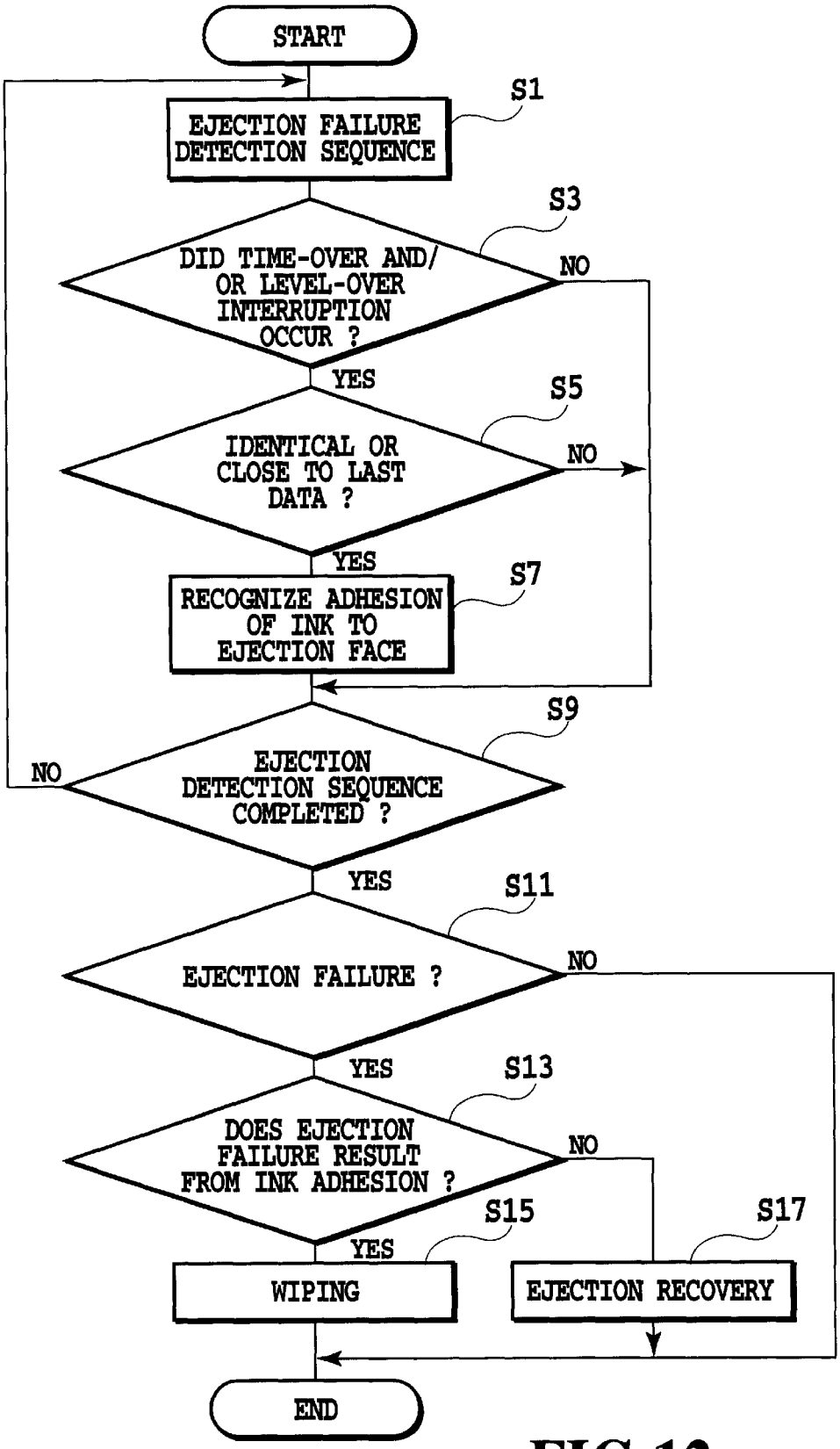
FIG. 12 is a flow chart showing an example of the series of ejection failure-detecting operations and a control procedure that can be executed corresponding to these operations, according to an embodiment of the present invention.

FIG. 12 shows an example of a control procedure based on the above described ejection failure detection sequences. In this figure, step S1 corresponds to one of the ejection failure detection sequences during the two forward scannings or to the ejection failure detection sequence during the single backward scanning as described above. Immediately after activation of this procedure, the ejection failure detection sequence with the first forward scanning is carried out. During the sequence, each nozzle is associated with its ink ejection state based on the ejection detection data 1236*a* and the time-over and level-over interruption signals 123*a* and 123*b*, and the time-over and/or level-over interruption is stored in the storage unit 124.

At the next step S3, the process determines whether or not the time-over and/or level-over interruption has occurred during the ejection failure detection sequence, and if the result is affirmative, compares this data with data obtained during the previous ejection failure detection sequence, at step S5. That is, it is determined whether or not the ejection opening associated with this interruption signal is located close to the ejection opening for which an ejection failure was detected during the previous ejection failure detection sequence (the ejection failure detection sequence with the first forward scanning before the ejection failure detection sequence with the backward scanning, or the ejection failure detection sequences with the backward scanning and with the first forward scanning before the second ejection failure detection sequence).

In this example, since the ejection openings for detection are shifted among the two forward scannings and one backward scanning, it can be determined whether the ejection opening associated with the interruption signal is located close to the previous ejection opening detected. If, however, a plurality of ejection failure detection sequences are carried out for each ejection opening, it may be also determined whether or not the ejection opening in which the ejection failure was detected during these sequences is identical. In either case, if the result is affirmative at step S5, then at step S7, the ejection failure is determined to result from adhesion of the ink to the ejection face. Corresponding data is then stored in the storage unit 124.

Additionally, a wiping procedure may be interposed between steps S3 and S5 so that the ejection face can be wiped when adhesion of the ink thereto is detected after one ejection failure detection sequence.

Next, at step S9, the process determines whether or not the series of ejection failure detection sequences (in this example, three such sequences) are completed, and if the result is negative, returns to step S1 to execute a next ejection failure detection sequence. On the other hand, if the result is affirmative, the process proceeds to step S11.

At step S11, the process determines whether or not an ejection failure has been detected during the series of ejection failure detection sequences, and if the result is negative, ends this procedure. Otherwise, the process determines whether or not this failure arises from adhesion of the ink to the ejection face (step S13). These determinations can be made based on information concerning the ink ejection state of each nozzle and information concerning the time-over and/or level-over interruption stored in the storage unit 124.

If the ejection failure originates from adhesion of the ink to the ejection face, the ejection face is wiped at step S15. Otherwise, the failure is assumed to be due to an increase in the viscosity of the ink in the liquid passage, adhesion of dust to the ejection opening, or other causes, and a recovery process is then executed. This recovery process may include a so-called suction recovery process for abutting a cap member on the ejection face to suck the ink through the ejection opening, or a pressurized recovery process for pressurizing the ink supply system for the head to push out the ink from the ejection opening in order to force ink ejection. Such the recovery process may be associated with wiping.

With the above processes, the adhesion of the ink to the ejection face can be accurately detected for effective wiping, and an efficient ejection recovery process can be executed when an ejection failure resulting from another cause is detected.

(Other Embodiments)

Although, in the description of the above embodiments, the ink jet print head includes the 16 nozzles, this is only illustrative and of course the number of nozzles is not limited to this but can be set arbitrarily. In addition, the above examples each use the three ejection failure detection sequences with different nozzles for detection, but of course the number of such sequences and the detection target can be set as appropriate depending on the mechanical configuration of the apparatus and the processing speed of the control system.

The head size, the print speed, and the laser beam angle can be set arbitrarily unless the set values deviate from the above described Equations (1) to (3).

(Others)

The present invention, in ink jet printing methods, achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, according to the present invention, the ejection of ink droplets is optically monitored based on the condition determined by the disposition pitch of the plurality of ink jet print heads, the main scanning speed of the ink jet print heads, the total number of ejection nozzles in each ink jet print head, the adjacent ejection nozzle pitch of each ink jet print head, the ejection cycle for the column in the main scanning direction, and the inter column distance in the main scanning direction. Consequently, ejection failures in the ink jet print heads can be promptly and reliably detected without affecting the actual print operation sequences. Additionally, the adhesion of the ink to the ejection opening can be detected simultaneously with the detection of the ejection failure, thereby effectively preventing an ejection failure arising from inappropriate wiping.

In addition, the ejection failure detection section requires no special movable mechanism for ink ejection detection, whereby a small-sized simply-configured apparatus is provided while reducing costs.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus for carrying out printing by moving an ink jet head in a scanning direction relative to a printing medium, said ink jet head having a plurality of ejection openings arranged therein for ejecting an ink, said apparatus comprising:

means for emitting a light beam in a direction which is different from an arrangement direction of the plurality of ejection openings and which traverses a trace of the ink ejection through the ejection openings;

means for receiving the emitted light beam;

means for controlling said light beam emitting means to emit the light beam and for controlling said ink jet head to eject ink through the plurality of ejection openings in accordance with predetermined data, while said ink jet head is being relatively moved in the scanning direction between said light beam emitting means and said light beam receiving means;

means for detecting ink ejection states from the plurality of ejection openings based on light beam receiving states at said light beam receiving means; and means for judging adhesion of ink to a face of said ink jet head on which the ejection openings are formed, based on the light beam receiving state at said light beam receiving means.

2. An ink jet printing apparatus as claimed in claim 1, wherein said light beam emitting means and said light beam receiving means are provided along the scanning direction of said ink jet head and outside a print area.

3. An ink jet printing apparatus as claimed in claim 1, further comprising wiping means for abutting on said face for wiping, and wherein when said judging means judges that the ink adheres to said face, said face is wiped after said detecting means has completed a series of detection sequences for the plurality of ejection openings.

4. An ink jet printing apparatus as claimed in claim 1, wherein said judging means determines whether an ejection opening for which a normal ejection has not been detected during detection sequences carried out by said detecting means for the plurality of ejection openings is identical and/or close to that for which normal ejection was not detected during the previous detection sequence, and wherein if the result of the determination is affirmative, said judging means judges that the ink adheres to said face.

5. An ink jet printing apparatus as claimed in claim 4, further comprising storage means for storing information of the ejection opening for which the normal ejection has not been detected during each of the detection sequences carried out by said detecting means for the plurality of ejection openings, and wherein said judging means makes the determination based on the information stored in said storage means.

6. An ink jet printing apparatus as claimed in claim 5, wherein on judging that the ink adheres to said face, said judging means allows said storage means to store this judgement.

7. An ink jet printing apparatus as claimed in claim 1, wherein said ink jet head has heating elements for generating thermal energy to make the ink to film-boil, as an energy used for ejecting the ink.

8. An ink jet printing apparatus a claimed in claim 1, wherein said judging means judges that ink adheres to said face of said ink jet head on which the ejection openings are formed when said light beam receiving state at said light beam receiving means shows a blocking state of the light beam for more than a predetermined time, and wherein ink is ejected from said plurality of ejection openings by said controlling means.

9. A method of judging an ink ejection state of an ink jet head for carrying out printing by moving in a scanning direction relative to a printing medium, the ink jet head having a plurality of ejection openings arranged therein for ejecting an ink, said method comprising the steps of:

controlling light emitting means to emit a light beam in a direction which is different from an arrangement direction of the plurality of ejection openings and which traverses a trace of the ink ejected through the ejection openings and controlling the ink jet head to eject ink through the plurality of ejection openings in accordance with predetermined data, while the ink jet head is being relatively moved in the scanning direction;

detecting ink ejection states from the plurality of ejection openings based on blocking states of the light beam; and judging adhesion of ink to a face of the ink jet head on which the ejection openings are formed, based on the light beam blocking state.

10. A judging method as claimed in claim 9, further comprising a step of wiping the face, on the judgement that the ink adheres to the face, after a series of detection sequences for the plurality of ejection openings are completed.

11. A judging method as claimed in claim 9, wherein said judging step includes the steps of determining whether that ejection opening for which a normal ejection has not been detected during detection sequences carried out by said detecting step for the plurality of ejection openings is identical and/or close to that for which the normal ejection was not detected during the previous detection sequence, and judging, if the result of the determination is affirmative, that the ink adheres to the face.

12. A judging method as claimed in claim 11, further comprising a step of storing information of the ejection opening for which the normal ejection has not been detected during each of the detection sequences carried out by said detecting step for the plurality of ejection openings, and wherein the determination is made based on the stored information.

13. A judging method as claimed in claim 12, wherein on judging that the ink adheres to the face, the judging step stores this judgement.

14. A judging method as claimed in claim 9, wherein the ink jet head has heating elements for generating thermal energy to make the ink to film-boil, as an energy used for ejecting the ink.

15. A judging method as claimed in claim 9, wherein judgement that ink adheres to the face of the ink jet head on which the ejection openings are formed is made when the light beam blocking state continues for more than a predetermined time, and wherein ink is ejected from the plurality of ejection openings by said controlling step.

* * * * *